US007440892B2

(12) United States Patent
Tamura

(10) Patent No.: US 7,440,892 B2
(45) Date of Patent: Oct. 21, 2008

(54) METHOD, DEVICE AND PROGRAM FOR EXTRACTING AND RECOGNIZING VOICE

(75) Inventor: Shinichi Tamura, Tajimi (JP)

(73) Assignee: Denso Corporation, Kariya (JP)

( * ) Notice: Subject to any disclaimer, the term of this patent is extended or adjusted under 35 U.S.C. 154(b) by 585 days.

(21) Appl. No.: 11/073,922

(22) Filed: Mar. 8, 2005

(65) Prior Publication Data

US 2005/0203744 A1 Sep. 15, 2005

(30) Foreign Application Priority Data

Mar. 11, 2004 (JP) ..... 2004-069436

(51) Int. Cl.
*G10L 21/02* (2006.01)
*G10L 11/02* (2006.01)

(52) U.S. Cl. ..... 704/233; 704/205; 704/228

(58) Field of Classification Search ..... 704/208, 704/219, 233, 255, 205, 226
See application file for complete search history.

(56) References Cited

U.S. PATENT DOCUMENTS

| | | | | | |
|---|---|---|---|---|---|
| 4,897,878 | A * | 1/1990 | Boll et al. | ..... | 704/233 |
| 4,972,490 | A * | 11/1990 | Thomson | ..... | 704/208 |
| 5,157,215 | A * | 10/1992 | Nakae et al. | ..... | 84/624 |
| 5,450,522 | A * | 9/1995 | Hermansky et al. | ..... | 704/205 |
| 5,642,464 | A * | 6/1997 | Yue et al. | ..... | 704/219 |
| 5,682,502 | A * | 10/1997 | Ohtsuka et al. | ..... | 704/267 |
| 5,828,996 | A * | 10/1998 | Iijima et al. | ..... | 704/219 |
| 6,134,518 | A * | 10/2000 | Cohen et al. | ..... | 704/219 |
| 6,308,155 | B1 * | 10/2001 | Kingsbury et al. | ..... | 704/231 |
| 6,985,860 | B2 * | 1/2006 | Nakatsuka | ..... | 704/233 |
| 7,054,454 | B2 * | 5/2006 | Causevic et al. | ..... | 704/211 |
| 2002/0010583 | A1 * | 1/2002 | Iwahashi et al. | ..... | 704/255 |
| 2003/0182104 | A1 * | 9/2003 | Muesch | ..... | 704/200.1 |

FOREIGN PATENT DOCUMENTS

JP A-2000-242624 9/2000

OTHER PUBLICATIONS

Lee et al., "Blind Source Separation of Real World Signals", Proceedings of IEEE International Conference Neutral Networks, U.S. A., Jun. 1997, pp. 2129-2135.

(Continued)

*Primary Examiner*—Talivaldis Ivars Smits
*Assistant Examiner*—Michael C Colucci
(74) *Attorney, Agent, or Firm*—Posz Law Group, PLC

(57) ABSTRACT

In a method of extracting voice components free of noise components from voice signals input through a single microphone, a signal-decomposing unit extracts independent signal components from the voice signals input through a single microphone by using a plurality of filters that permit the passage of signal components of different frequency bands. A signal-synthesizing unit synthesizes the signal components according to a first rule to form a first synthesized signal, and synthesizes the signal components according to a second rule to form a second synthesized signal. The first and second rules are so determined that a difference becomes a maximum between the probability density function of the first synthesized signal and the probability density function of the second synthesized signal. An output selection unit selectively produces a synthesized signal having a large difference from the Gaussian distribution between the synthesized signals.

14 Claims, 8 Drawing Sheets

OTHER PUBLICATIONS

Principe et al., "Chapter 7, Information-Theoretic Learning", pp. 1-62.

Bell et al., An Information-Maximisation Approach to Blind Separation and Blind Deconvolution, pp. 1-38.

Hyvärinen et al., "New Approximations of Differential Entropy for Independent Component Analysis and Projection Pursuit".

* cited by examiner

METHOD, DEVICE AND PROGRAM FOR EXTRACTING AND RECOGNIZING VOICE

CROSS REFERENCE TO RELATED APPLICATION

This application is based upon, claims the benefit of priority of, and incorporates by reference the contents of, Japanese Patent Application No. 2004-69436 filed on Mar. 11, 2004.

FIELD OF THE INVENTION

The present invention relates to a method, program and device for extracting and recognizing a voice and, more particularly, to a method and device in which voice components are selectively extracted from digital voice signals containing voice components and noise components.

BACKGROUND OF THE INVENTION

There has heretofore been known a device for recognizing the voice, which collects the voice uttered by a user by using microphones, compares the voice with a pattern of voice that has been stored in advance as a recognized word, and recognizes a recognized word having a high degree of agreement as the word uttered by the user. The device for recognizing the voice of this kind has been incorporated in, for example, a car navigation device, etc.

It has also been known that the voice recognition factor of the device for recognizing the voice is dependent upon the amount of noise components contained in the voice signals input through the microphones. To solve this problem, the device for recognizing the voice is provided with a device for extracting the voice, which selectively extracts only those voice components representing the feature of voice of the user from the voice signals input through the microphones.

According to a known method of extracting the voice, the sound in the same room is collected by using a plurality of microphones, and the voice components are separated from the noise components based on the signals input through the plurality of microphones to thereby extract the voice components. According to the method of extracting the voice, the voice components are selectively extracted by the independent component analysis method (ICA) by utilizing the fact that the voice components and the noise components contained in the signals input through the microphones are statistically independent from each other (e.g., see Te-Won Lee, Anthony J. Bell, Reinhold Orglmeister, "Blind Source Separation of Real World Signals", Proceedings of IEEE International Conference Neutral Networks, U.S.A., June 1997, pp. 2129-2135, the contents of which are incorporated herein by reference).

However, the above conventional technology involves the following problems. That is, in the conventional method of extracting the voice based on the independent component analysis, the number of microphones provided in the space must be equal to the number of independent components contained in the voice signals (i.e., a number one representing the extracted voice component is added to a number equal to the number of noise components). Even when the voice components are extracted by relying upon the conventional method of independent component analysis by providing the microphones in a plural number, there remains a problem in that the voice components cannot be suitably extracted when the number of noise components (i.e., the number of the noise sources) varies from time to time.

Further, there remains a problem in that the hardware constitution becomes complex when the signals input through the plurality of microphones are to be processed. In particular, a storage medium (memory, et.) of a large capacity must be provided for storing the input signals (digital data), thereby driving up the cost of production when the input signals from the microphones are to be digitally processed.

SUMMARY OF THE INVENTION

In view of the above problems, it is an object of providing a method of extracting voice capable of suitably extracting the voice components from the voice signals input through a single microphone without using a plurality of microphones, a device for extracting the voice, a device for recognizing the voice equipped with the device for extracting the voice, and a program used for the device for extracting the voice.

In order to achieve the above object, according to a method of extracting the voice, the voice signals input through a microphone are decomposed into signal components of a plurality of kinds (different frequency bands) by using a plurality of filters, so that the voice components and the noise components assume different spectra. The voice components and the noise components can then be separated into signal components containing noise components and signal components containing voice components. If the signal components are synthesized according to a predetermined rule, there can be formed synthesized signals emphasizing the voice components.

According to a method of extracting the voice of a first aspect, signal components of a plurality of kinds are extracted from the digital voice signals by using a plurality of filters (step (a)), and the signal components are synthesized according to a first rule to form a first synthesized signal. Further, the signal components are synthesized according to a second rule different from the first rule to form a second synthesized signal (step (b)). Between the first and second synthesized signals that are formed, a synthesized signal expressing the feature of the voice components is selectively output (step (c)) to extract the voice component from the digital voice signal.

In forming the first and second synthesized signals, the first and second rules are determined based on the statistic feature quantities of the first and second synthesized signals. Here, the first and second rules may be determined based on the characteristic feature quantities of the first and second synthesized signals formed in the last time, may be determined based on the characteristic feature quantities of the first and second synthetic signals that are formed as dummy signals, or may be determined by estimating in advance the statistic feature quantities of the first and second synthesized signals by a mathematical method and based on the results thereof.

Accordingly, the first and second rules are determined based on the statistic feature quantities so as to form synthesized signals expressing the feature of the voice components, and the voice components are extracted from the digital voice signals. Unlike the conventional method of extracting the voice using the microphones of a number equal to the number of sound sources, therefore, the voice components can be favorably extracted by using a single microphone. Also, the voice components can be suitably extracted even in an environment where the number of the noise components (noise sources) varies from time to time.

Further, there is no need of processing the input signals from a plurality of microphones, but the signals input through a single microphone are processed to extract the voice components. Therefore, employment of the above method makes it possible to inexpensively produce the device for extracting the voice without using a high-performance computer or a memory of a large capacity.

In the above method of extracting the voice, the signal components of a plurality of kinds may be extracted by using a plurality of filters having fixed filter characteristics. According to a second aspect, however, the impulse responses of a plurality of filters are set so that the signal components extracted by the filters become independent from, or uncorrelated to, each other, and the signal components of a plurality of kinds independent from, or uncorrelated to, each other are extracted from the digital voice signals by using the plurality of filters.

To form the synthesized signals emphasizing the voice components, the signal components extracted by the filters must contain either the voice components or the noise components in large amounts. However, in a space where the noise sources cannot be specified, it is not possible to separate the signal components of the sound sources in an optimum manner from the digital voice signals even if filters having fixed filter characteristics are used. Therefore, even if the synthesized signals are formed as described above while maintaining the characteristics of the filters constant, it is probable that optimum synthesized signals emphasizing the voice components may not be formed from the signal components extracted by using the fixed filters.

On the other hand, if the impulse responses of the filters are set so that the signal components extracted by the filters become independent from, or uncorrelated to, each other, it becomes possible to nearly suitably separate and extract the signal components of the sound sources by using the filters since the voice components and the noise components can be approximately regarded to be independent from, or uncorrelated to, each other. Upon synthesizing them, there can be formed synthesized signals selectively emphasizing the voice components.

According to a second aspect of a method of extracting the voice in which the impulse responses of the plurality of filters are set so that the signal components extracted by the filters become independent from, or uncorrelated to, each other, it is allowed to extract the desired voice components from the digital voice signals more accurately.

When the impulse responses of the filters are set so that the signal components extracted by the filters become uncorrelated to each other, the impulse responses can be derived through the operation of an amount smaller than that of when the impulse responses of the filters are so set that the signal components extracted by the filters become independent from each other. On the other hand, when the impulse responses of the filters are set so that the signal components extracted by the filters become independent from each other, the voice components can be extracted more accurately than when the impulse responses of the filters are set so that the signal components extracted by the filters become uncorrelated to each other.

According to a third aspect, it is desired that the filters are digital band-pass filters of the FIR (finite impulse response) type or of the IIR (infinite impulse response) type. Use of the IIR filters offers an advantage of a decreased amount of operation while use of the FIR filters offers an advantage of small signal distortion and highly accurate extracting of desired signal components.

As the statistic feature quantities used for determining the first and second rules, there can be exemplified a quantity representing a difference between the probability density functions of the first and second synthesized signals (concretely, a quantity expressed by the formula (15) appearing later) and a mutual data quantity for the first and second synthesized signals (concretely, a quantity expressed by the formula (38) appearing later).

The probability density function greatly differs depending upon the voice component and the noise component. Therefore, according to a fourth aspect, the first and second rules are so determined that a quantity representing a difference between the probability density functions of the first and second synthesized signals becomes a maximum, to form a synthesized signal suitably emphasizing the voice component and to favorably extract the voice component.

The voice component and the noise component are approximately independent from each other. According to a fifth embodiment, therefore, the first and second rules are so determined that the data quantity of the first and second synthesized signals becomes a minimum to form a synthesized signal suitably emphasizing the voice component and to favorably extract the voice component like when the first and second rules are determined using, as an index, the quantity representing a difference between the probability density functions.

According to a sixth aspect, the first and second rules are determined using, as indexes, the quantity representing a difference between the probability density functions of the first and second signals and the data quantity of the first and second synthesized signals, to form a synthesized signal emphasizing the voice component more favorably and improving the voice component extract performance.

In the above method of extracting the voice according to a seventh aspect, rules related to weighing the signal components extracted in step (a) are determined as first and second rules to form synthesized signals. At the time of synthesis, the signal components are weighed and added up according to the first rule to form a first synthesized signal, and the signal components are weighed and added up according to the second rule to form a second synthesized signal. By employing the method of forming the synthesized signals by weighing and adding up the signal components, it is allowed to form the synthesized signals that meet the above-mentioned conditions simply and at high speeds.

In selecting either the first synthesized signal or the second synthesized signal as a synthesized signal to be output according to an eighth aspect, the first synthesized signal and the second synthesized signal formed at the step (b) are evaluated for their differences from the Gaussian distribution, and the synthesized signal evaluated to have the greatest difference from the Gaussian distribution may be selected as the synthesized signal expressing the feature of voice component.

As is well known, the noise components approximately assume the Gaussian distribution. Therefore, if the first and second synthesized signals are evaluated for their differences from the Gaussian distribution, it is allowed to simply and suitably judge which one of the two synthesized signals most express the feature of voice component.

According to ninth through sixteenth aspects, the method of extracting the voice may be applied to a device for extracting the voice. The device for extracting the voice according to the ninth aspect includes a plurality of filters, extract means, first synthesizing means, second synthesizing means, selective output means and determining means, wherein the extract means extracts a plurality of kinds of signal components from the digital voice signals input from an external unit by using a plurality of filters.

The first synthesizing means synthesizes the signal components extracted by the extract means according to the first rule to form a first synthesized signal, and the second synthesizing means synthesizes the signal components extracted by the extract means according to the second rule different from the first rule to form a second synthesized signal. The first and second rules are determined by the above determining means based on the statistic feature quantities of the first synthesized signal formed by the first synthesizing means and of the second synthesized signal formed by the second synthesizing means. Of the first synthesized signal formed by the first synthesizing means and the second synthesized signal formed by the second synthesizing means, the synthesized signal expressing the feature of the voice component is selectively output by the selective output means.

In the device for extracting the voice according to the ninth aspect, like in the method of extracting the voice of the first aspect, the first and second rules are determined based on the statistic feature quantities, a synthesized signal emphasizing the voice component is formed, and the voice component is extracted from the digital voice signals, making it possible to favorably extract the voice components using a single microphone. Even in an environment where the number of noise components (noise sources) varies from time to time, it is allowed to suitably extract the voice components. Accordingly, a plurality of microphones need not be used but the signals input through a single microphone may be processed. Therefore, the device for extracting the voice does not require a high-performance computer or a large capacity memory, and the product can be inexpensively manufactured.

In the device for extracting the voice according to a tenth aspect, the extract means sets the impulse responses of the plurality of filters such that the signal components extracted by the filters become independent from, or uncorrelated to, each other, and the plurality of kinds of signal components which are independent from, or uncorrelated to, each other, are extracted from the digital voice signals by using the plurality of filters.

According to the device for extracting the voice, like in the method of extracting the voice of the second aspect, suitable signal components can be extracted depending upon a change in the noise sources to suitably form and produce a synthesized signal that favorably expresses the feature of the voice component. In the device for extracting the voice according to an eleventh aspect, it is allowed to use digital band-pass filters of the FIR type or the IIR type as the filters.

In the device for extracting the voice according to a twelfth aspect, the determining means determines the first and second rules in a manner that a quantity expressing a difference between the probability density functions of the first and second synthesized signals becomes a maximum. In the device for extracting the voice according to a thirteenth aspect, the determining means determines the first and second rules in a manner that a mutual data quantity for the first and second synthesized signals becomes a minimum. By determining the first and second rules as in the devices for extracting the voice of the twelfth and thirteenth aspects, it is made possible to form synthesized signals suitably emphasizing the voice components and to favorably extract the voice components like in the methods of extracting the voice of the fourth and fifth aspects.

As in the device for extracting the voice of a fourteenth aspect, further, if the determining means is so constituted as to determine the first and second rules based upon the quantity expressing a difference between the probability density functions of the first and second synthesized signals and upon the mutual data quantity for the first and second synthesized signals, then, the voice components can be extract more favorably.

In the device for extracting the voice according to a fifteenth aspect, the determining means determines the rules (first and second rules) related to weighing the signal components extracted by the extract means, the first synthesizing means weighs and adds up the signal components extracted by the extract means according to the first rule to form a first synthesized signal, and the second synthesizing means weighs and adds up the signal components extracted by the extract means according to the second rule to form a second synthesized signal. The device for extracting the voice forms the synthesized signals that meet the above conditions simply and at high speeds.

In the device for extracting the voice according to a sixteenth aspect, the selective output means includes evaluation means for evaluating the first synthesized signal formed by the first synthesizing means and the second synthesized signal formed by the second synthesizing means for their differences from the Gaussian distribution, and the synthesized signal evaluated by the evaluation means to possess the greatest difference from the Gaussian distribution is selectively output as the synthesized signal expressing the feature of the voice component. According to the device for extracting the voice of the sixteenth aspect, it is allowed to simply and suitably evaluate which one of the two synthesized signals has the best feature of voice component.

A device for recognizing the voice according to a seventeenth aspect recognizes the voice by using synthesized signals produced by the selective output means in the device for extracting the voice of the ninth to sixteenth aspects. In the device for extracting the voice, the selective output means produces a synthesized signal in which the voice component only is selectively emphasized. Therefore, the device for recognizing the voice recognizes the voice by using signals output from the device for extracting the voice more accurately than that of the prior art.

Here, a computer may realize the functions of the filters, extract means, first synthesizing means, second synthesizing means, selective output means and determining means included in the apparatus for extracting the voice of the ninth to sixteenth aspects.

A program according to an eighteenth aspect, when installed in a computer, permits the computer to realize the functions of the filters, extract means, first synthesizing means, second synthesizing means, selective output means and determining means. If this program is executed by the CPU of the data processing apparatus, then, the data processing apparatus can be operated as the device for extracting the voice. The program may be stored in a CD-ROM, DVD, hard disk or semiconductor memory, and may be offered to the users.

BRIEF DESCRIPTION OF THE DRAWINGS

The above and other objects, features and advantages of the present invention will become more apparent from the following detailed description made with reference to the accompanying drawings. In the drawings.

DESCRIPTION OF THE PREFERRED EMBODIMENTS

Figure 1:
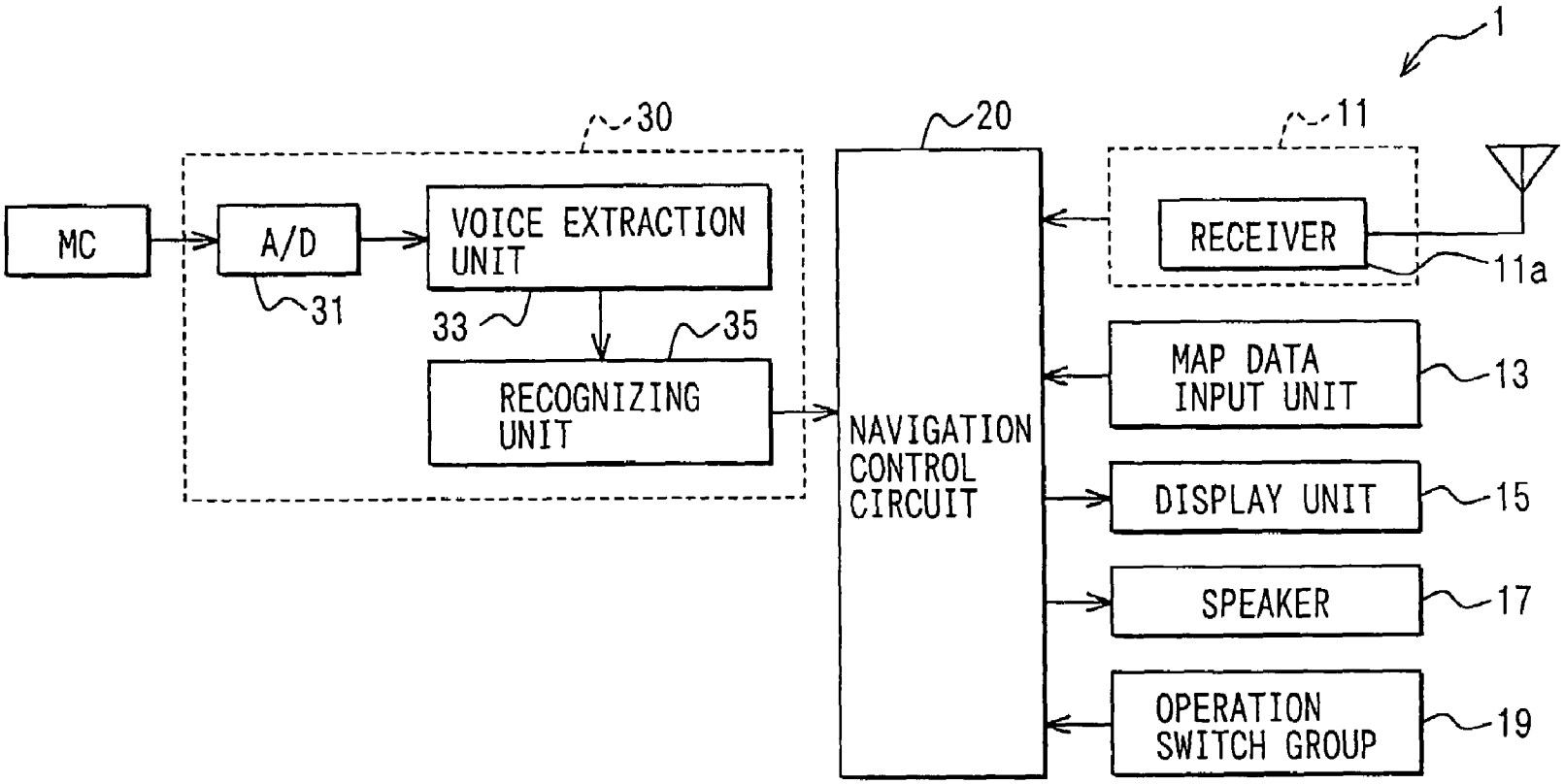
FIG. 1 is a block diagram illustrating the constitution of a navigation system.

Preferred embodiments will now be described with reference to the drawings. FIG. 1 is a block diagram illustrating the constitution of a navigation system 1 in which the method, device and program are implemented. The navigation system 1 of this embodiment is built in a vehicle and includes a position detecting device 11, a map data input unit 13, a display unit 15 for displaying a variety of information (map, etc.), a speaker 17 for producing the voice, an operation switch group 19 by which the user inputs various instructions to the system, a navigation control circuit 20, a voice recognizing apparatus 30, and a microphone MC.

The position detecting device 11 includes a GPS receiver 11*a* which receives satellite signals transmitted from a GPS satellite and calculates the coordinate (longitude, latitude, etc.) of the present position, and various sensors necessary for detecting the position of a well-known gyroscope (not shown). The outputs from the sensors in the position detecting device 11 contain errors of different natures. Therefore, the position detecting device 11 is constituted to specify the present position by using a plurality of such sensors. Depending upon the required accuracy for detecting the position, the position detecting device 11 may be constituted by using some of the above sensors, or may be further provided with a terrestrial magnetism sensor, a steering wheel rotation sensor, a wheel sensor of the wheels, a vehicle speed sensor, and a slope sensor for detecting the slope angle of the road surface.

The map data input unit 13 is for inputting map-matching data for correcting the position and road data representing the junction of the road, to the navigation control circuit 20. The map-matching data is preferably stored in a storage medium, which may be a CD-ROM, DVD, hard disk or the like.

The display unit 15 is a color display unit such as a liquid crystal display, and displays the present position of the vehicle and the map image on a screen based on video signals input from the navigation control circuit 20. The speaker 17 reproduces voice signals received from the navigation control circuit 20, and is used for providing voice guidance for the route to the destination.

The navigation control unit 20 is constituted by a known microcomputer and executes various processing related to navigation according to instruction signals input from the operation switch group 19. For example, the navigation control circuit 20 displays, on the display unit 15, a road map around the present position detected by the position detecting device 11, and a mark on the road map to represent the present position. Further, the navigation control circuit 20 searches the route up to the destination and displays, on the display unit 15, various guides so that the driver of the vehicle can travel the vehicle along the route, and produces guides by voice through the speaker 17. Further, the navigation control circuit 20 executes various processing which are executed by known car navigation devices, such as guidance to facilities in the vicinity, changing the area and scale of the road map displayed on the display unit 15, etc.

The navigation control circuit 20, further, executes various processing corresponding to the voice recognized by the voice recognizing apparatus 30 according to the results of voice recognition input from the voice recognizing apparatus 30.

The voice recognizing apparatus 30 includes an analog/digital converter 31 for converting an analog voice signal input through the microphone MC into a digital signal (hereinafter referred to as "digital voice signal"), a voice extraction unit 33 for selectively extracting the voice component from a digital voice signal input from the analog/digital converter 31 and for outputting the voice component, and a recognizing unit 35 for recognizing the voice of the user input through the microphone MC based on a signal output from the voice extraction unit 33.

The recognizing unit 35 acoustically analyzes a synthesized signals Y1(u) or Y2(u) (will be described later) output from an output selection unit 49 in the voice extraction unit 33, compares the feature quantity (e.g., spectrum) of the signal with a voice pattern that has been registered to a voice dictionary according to a known method, recognizes a vocabulary corresponding to the voice pattern having a high degree of agreement as the one uttered by the user, and inputs the recognized result to the navigation control circuit 20.

The voice recognizing apparatus 30 may further be provided with a ROM storing a program to have the CPU exhibit the functions as the voice extraction unit 33 and the recognizing unit 35, in addition to being provided with the CPU and the RAM. Namely, the program is suitably executed by the CPU such that the voice recognizing apparatus 30 is provided with the voice extraction unit 33 and the recognizing unit 35, or is provided with a dedicated large scale integration (LSI) chip.

Figure 2A:
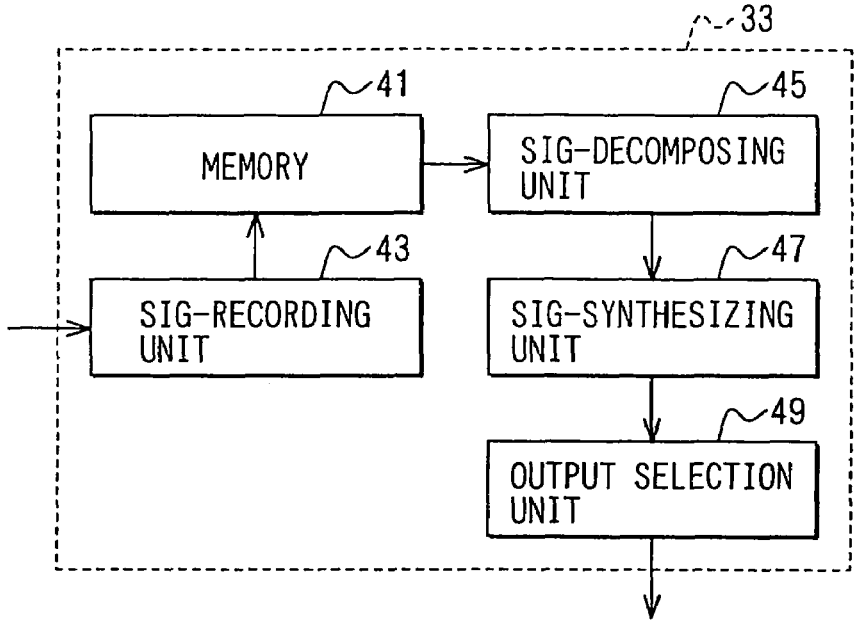
FIG. 2A is a functional block diagram illustrating the constitution of a voice extraction unit included in an apparatus for recognizing the voice.
Figure 2B:
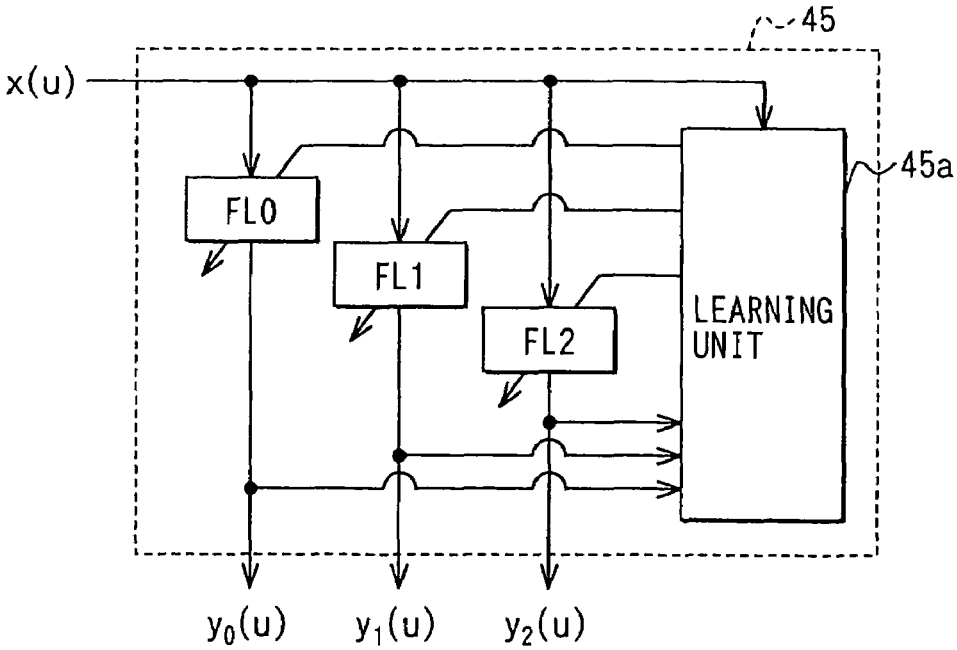
FIG. 2B is a functional block diagram illustrating the constitution of a signal-decomposing unit.

FIG. 2A is a functional block diagram illustrating the constitution of the voice extraction unit 33 provided in the voice recognizing apparatus 30, and FIG. 2B is a functional block diagram illustrating the constitution of the signal-decomposing unit 45 provided in the voice extraction unit 33.

The voice extraction unit 33 is for selectively extracting and outputting the voice component from the digital voice signal containing the voice component uttered by the user and the noise component of the surrounding noise. The voice extraction unit 33 includes a memory (RAM) 41 for storing the digital voice signals, a signal-recording unit 43 for writing the digital voice signals input from the analog/digital converter 31 into a memory 41, a signal-decomposing unit 45 for separating and extracting a plurality of kinds of signal components from the digital voice signals, a signal-synthesizing unit 47 for weighing and synthesizing a plurality of signal components separated and extracted by the signal-decomposing unit 45 according to a plurality of rules and for producing the synthesized signals according to the rules, and an output selection unit 49 for selecting a synthesized signal which most expresses the feature of the voice from among the synthesized signals output from the signal-synthesizing unit 47 and for producing the synthesized signal that is selected as an extracted signal of the voice component.

The signal-recording unit 43 successively stores in memory 41 the digital voice signals mm(u) at various moments input from the analog/digital converter 31. Concretely, the signal-recording unit 43 of this embodiment is constituted to record in the memory 41 the digital voice signals up to a point of a second before from the present moment. When the voice signals input through the microphone MC are sampled at a sampling frequency N (Hz) (e.g., N=10000), the digital voice signals mm(N−1), mm(N−2), mm(0) of a number of N to the past from the present moment are stored in the memory 41 at all times due to the operation of the signal-recording unit 43.

The signal-decomposing unit 45 includes a plurality of (preferably, three) filters FL0, FL1, FL2, and a filter learning unit 45*a* for setting impulse responses (filter coefficients) for the filters FL0, FL1, FL2. The filters FL0, FL1 and FL2 are constituted as digital filters of the FIR (finite impulse response) type. Filter coefficients {W00, W01, W02} are set to the filter FL0, filter coefficients {W10, W11, W12} are set to the filter FL1, and filter coefficients {W20, W21, W22} are set to the filter FL2.

These filters FL0, FL1, FL2 filter the digital voice signals by using the digital voice signals mm(u), mm(u−1) and mm(u−2) at moments u, u−1 and u−2 read from the memory 41, and extract a plurality of kinds of signal components $y_0(u)$, $y_1(u)$ and $y_2(u)$ from the digital voice signals. Relationships between the plurality of signal components $y_0(u)$, $y_1(u)$, $y_2(u)$ and the digital voice signals mm(u), mm(u−1), mm(u−2) are expressed by the following formulas.

$$y(u) = \begin{bmatrix} y_0(u) \\ y_1(u) \\ y_2(u) \end{bmatrix} = W \cdot x(u) \tag{1}$$

$$W = \begin{bmatrix} W_{00} & W_{01} & W_{02} \\ W_{10} & W_{11} & W_{12} \\ W_{20} & W_{21} & W_{22} \end{bmatrix} \tag{2}$$

$$x(u) = \begin{bmatrix} mm(u) \\ mm(u-1) \\ mm(u-2) \end{bmatrix} \tag{3}$$

Concretely speaking, the filters FL0, FL1 and FL2 are constituted as band-pass filters for extracting the signal components of different frequency bands by updating the impulse responses (filter coefficients) through the signal-decomposing processing that will be described later. The filter FL0 extracts and outputs signal component $y_0(u)$ independent of the signal components $y_1(u)$ and $y_2(u)$ from the digital voice signal x(u) of the above formula (3). The filter FL1 extracts and outputs the signal component $y_1(u)$ independent of the signal components $y_0(u)$ and $y_2(u)$ from the digital voice signal x(u). The filter FL2 extracts and outputs the signal component $y_2(u)$ independent of the signal components $y_0(u)$ and $y_1(u)$ from the digital voice signal x(u).

Figure 3A:
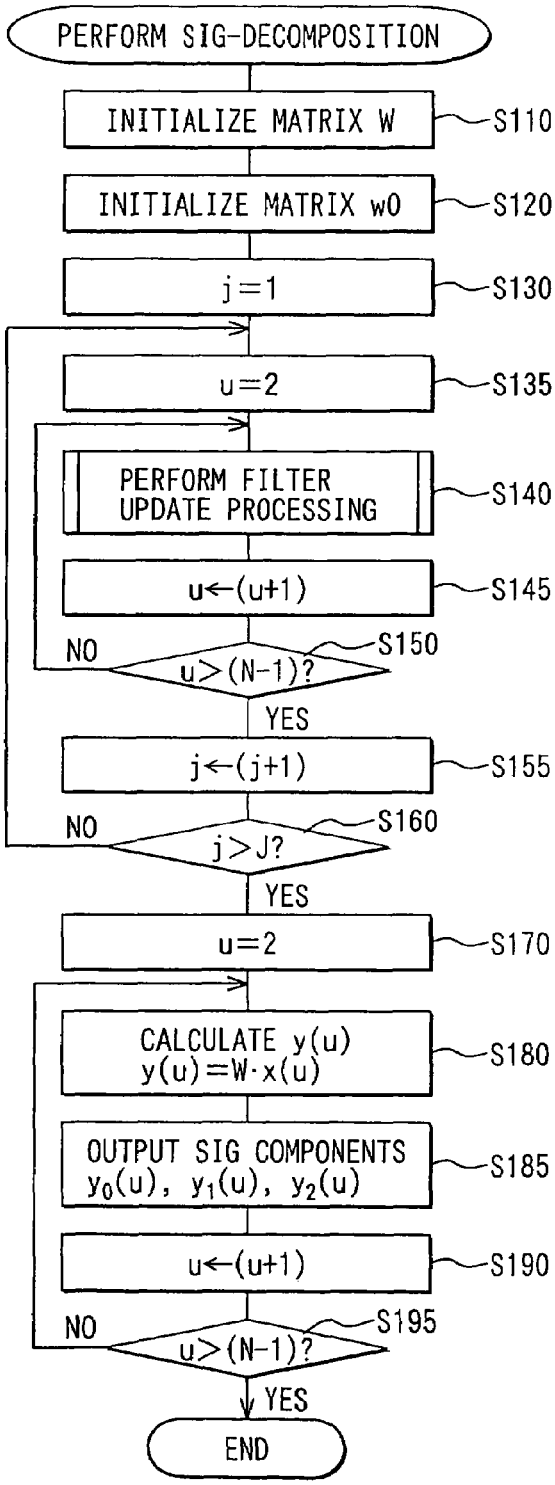
FIG. 3A is a flowchart illustrating a signal-decomposing processing executed by the signal-decomposing unit.
Figure 3B:
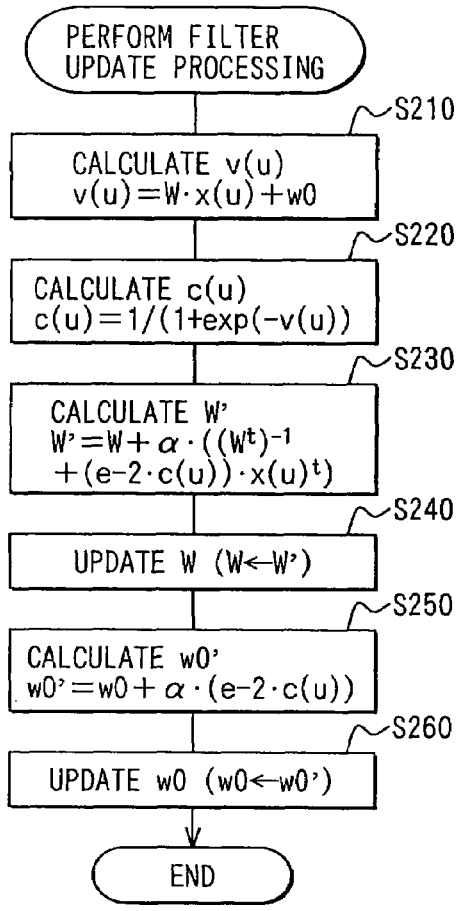
FIG. 3B is a flowchart illustrating a filter-updating processing executed by the signal-decomposing unit.

The functions of the filters FL0, FL1, FL2 and of the filter learning unit 45*a* are realized when the signal-decomposing unit 45 executes the signal-decomposing processing illustrated in FIGS. 3A-3B, which are flowcharts illustrating the signal-decomposing processing executed by the signal-decomposing unit 45. The signal-decomposing processing is repetitively executed for every second.

When the signal-decomposing processing is executed, the signal-decomposing unit 45 sets the elements of the matrix W to the initial values (S110) and sets the elements of the matrix w0 to the initial values (S120). The matrix W has three rows and three columns while the matrix w0 has three rows and one column. In this embodiment, random numbers (e.g., from −0.001 to +0.001) are set as initial values of the elements of the columns W and w0. Thereafter, the signal-decomposing unit 45 sets a variable j to an initial value j=1 (S130), sets a variable u to an initial value u=2 (S135), and executes a filter-updating processing (S140).

FIG. 3B is a flowchart illustrating the filter-updating processing executed by the signal-decomposing unit 45. In the filter-updating processing, the values of elements of the matrix W having filter coefficients W00, W01, W02, W10, W11, W12, W20, W21, W22 as elements are updated based on the infomax method which has been known as a method of independent component analysis (ICA), so that the signal components $y_0(u)$, $y_1(u)$ and $y_2(u)$ become independent from each other.

Concretely speaking, when the filter-updating processing is executed, the signal-decomposing unit 45 calculates the value v(u) of the variable u that has now been set according to the following formula (S210).

$$v(u) = \begin{bmatrix} v_0(u) \\ v_1(u) \\ v_2(u) \end{bmatrix} = W \cdot x(u) + w0 \tag{4}$$

Thereafter, the elements of the value v (u) are substituted into the Sigmoid function to calculate the value c(u) (S220).

$$c(u) = \begin{bmatrix} c_0(u) \\ c_1(u) \\ c_2(u) \end{bmatrix} = \begin{bmatrix} \dfrac{1}{1+\exp(-v_0(u))} \\ \dfrac{1}{1+\exp(-v_1(u))} \\ \dfrac{1}{1+\exp(-v_2(u))} \end{bmatrix} \tag{5}$$

After the processing at S220, the signal-decomposing unit 45 calculates a new matrix W' to substitute for the matrix W by using the value c(u) (S230). Here, the vector e is the one of three rows and one column in which each element has a value 1. Further, α is a constant representing the learning rate and t is a transposition.

$$W' = W + a \cdot ((W^t)^{-1} + (e - 2 \cdot c(u)) \cdot x(u)^t) \tag{6}$$

$$e = \begin{bmatrix} 1 \\ 1 \\ 1 \end{bmatrix}$$

Thereafter, the signal-decomposing unit 45 substitutes the matrix W' calculated at S230 for the matrix W to update the matrix W to W=W' (S240). After the processing at S240, the signal-decomposing unit 45 calculates a new matrix w0' to substitute for the matrix w0 by using the value c(u) (S250).

$$w0' = w0 + \alpha \cdot (e - 2 \cdot c(u)) \tag{7}$$

After the processing at S250, the signal-decomposing unit 45 substitutes the matrix w0' calculated at S250 for the matrix w0 to update the matrix w0 to w0=w0' (S260). Thereafter, the filter-updating processing ends.

After the filter-updating processing, the signal-decomposing unit 45 increases the value of the variable u by 1 (S145) and, then, judges whether the value of the variable u is greater than a maximum value (N−1) (S150). When it is judged that the value of the variable u is smaller than the maximum value (N−1) (no at S150), the filter-updating processing is executed again for the value of the variable u (S140). After the filter-updating processing, the variable u is increased again by 1 (S145). The signal-decomposing unit 45 repeats these operations (S140 to S150) until the value of the variable u exceeds the maximum value (N−1).

When it is judged that the value of the variable u has exceeded the maximum value (N−1) (yes at S150), the value of the variable j is increased by 1 (S155). Thereafter, the signal-decomposing unit 45 judges whether the value of the variable j is greater than a maximum value J that has been set in advance (S160). When it is judged that the value of the variable j is smaller than the constant J (no at S160), the routine proceeds to S135 where the variable u is set to the initial value u=2, and the processing is executed from S140 up to S155. The maximum value J is set by expecting the rate at which the matrix W converges, and is set to be, for example, J=10.

When it is judged that the value of the variable j is greater than the constant J (yes at S160), on the other hand, the signal-decomposing unit 45 sets the variable u to u=2 (S170), and calculates the signal components $y_0(u)$, $y_1(u)$ and $y_2(u)$ according to the formula (1) by using the latest matrix W updated at S240 (S180), and outputs them to (S185).

Thereafter, the signal-decomposing unit 45 increases the value of the variable u by 1 (S190) and judges whether the value of the variable u after being increased is greater than the maximum value (N−1) (S195). When it is judged that the value of the variable u is smaller than the maximum value (N−1) (no at S195) the routine returns to S180 where the signal components $y_0(u)$ $y_1(u)$ and $y_2(u)$ are calculated for the variable u after increased, and are output (S185). When it is judged that the value of the variable u after increased is larger than the maximum value (N−1) (yes at S195), the signal-decomposing processing ends. Owing to the above operations, the signal-decomposing unit 45 produces the signal components $y_0(u)$, $y_1(u)$ and $y_2$ (u) which are independent from each other.

Figure 4:
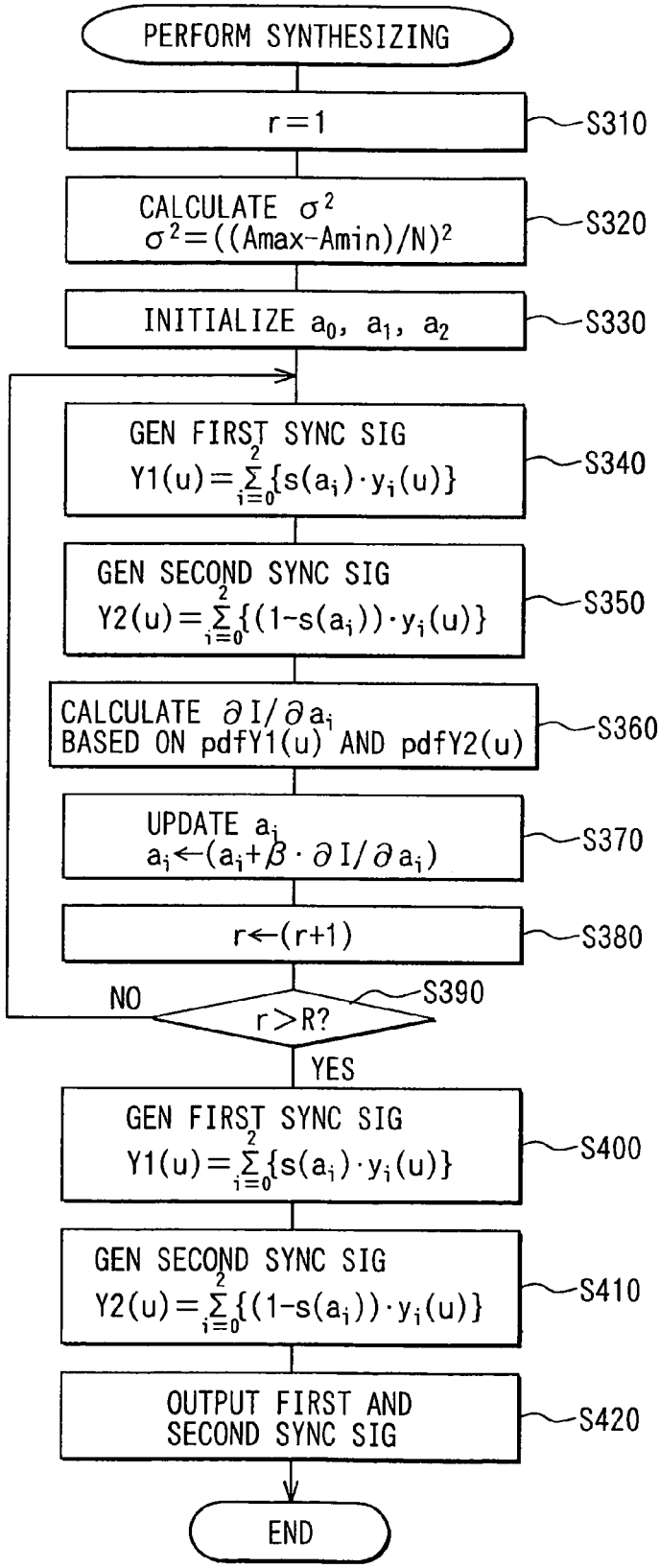
FIG. 4 is a flowchart illustrating a synthesizing processing executed by a signal-synthesizing unit.

Next, described below is the signal-synthesizing unit 47. The signal-synthesizing unit 47 executes a synthesizing processing illustrated in FIG. 4. The unit 47 weighs and synthesizes the signal components $y_0(u)$, $y_1(u)$ and $y_2(u)$ output from the signal-decomposing unit 45 according to a first rule to form a first synthesized signal y(u), and weighs and synthesizes the signal components $y_0(u)$, $y_1(u)$ and $y_2(u)$ output from the signal-decomposing unit 45 according to a second rule different from the first rule to form a second synthesized signal Y2(u). FIG. 4 is a flowchart illustrating the synthesizing processing executed by the signal-synthesizing unit 47.

When the synthesizing processing is executed, the signal synthesizing unit 47 sets the variable r to an initial value r=1 (S310), and calculates a value $\sigma^2$ based on a maximum amplitude $A_{max}$ and a minimum amplitude $A_{min}$ of the digital voice signals mm(N−1), - - - , mm(0) in one initial second in which the signal components $y_0(u)$, $y_1(u)$ and $y_2(u)$ were extracted by the signal-decomposing unit 45 (S320).

$$\sigma^2=((A_{max}-A_{min})/N)^2 \tag{8}$$

Thereafter, the signal-synthesizing unit 47 sets variables $a_0$, $a_1$ and $a_2$ to initial values (S330), and forms a first dummy synthesized signal Y1(u) and a second dummy synthesized signal Y2(u) for U=2, 3, - - - , N−2, N−1 (S340, S350). Here, as represented by the formula (11), $s(a_i)$ is a Sigmoid function of a variable $a_i$ (i=0, 1, 2).

$$Y1(u) = \sum_{i=0}^{2} s(a_i)\cdot y_i(u) \tag{9}$$

$$Y2(u) = \sum_{i=0}^{2} (1 - s(a_i))\cdot y_1(u) \tag{10}$$

$$s(a_i) = \frac{1}{1+\exp(-a_i)} \tag{11}$$

When the synthesized signals Y1(u) and Y2(u) are calculated, the signal-synthesizing unit 47 calculates the slopes ∂I/∂a0 (a0=b0(r)), ∂I/∂a1(a1=b1(r)), ∂I/∂a2(a2=b2(r)) for the quantity I(p1, p2) representing a difference between the probability density function p1(z) of the synthesized signal Y1(u) and the probability density function p2(z) of the synthesized signal Y2(u) (S360). Here, when the variable is r=1, 2, - - - , R−1, R, the value set to the variable $a_i$ at S340 to S360 is expressed as bi(r).

Next, described below is how to calculate the slopes ∂I/∂a0 (a0=b0(r)), ∂I/∂a1(a1=b1(r)) and ∂I/∂a2(a2=b2(r)). First, by using the Parzen method, the probability density function p1(z) of the synthesized signal Y1(u) and the probability density function p2(z) of the synthesized signal Y2(u) are estimated as expressed below. As for the Parzen method, reference should be made to Simon S. Haykin, "Unsupervised Adaptive Filtering, Volume 1, Blind Source Separation", Wiley, p. 273, the contents of which are incorporated herein by reference.

$$p1(z) = (1/(N-2))\sum_{u=2}^{N-1} G(z - Y1(u), \sigma^2) \tag{12}$$

$$p2(z) = (1/(N-2))\sum_{u=2}^{N-1} G(z - Y2(u), \sigma^2) \tag{13}$$

The function G(q, $\sigma^2$) is a Gaussian probability density function in which the variance is $\sigma^2$ as represented by the formula (14). Here, q=z−Y1(u) or q=z−Y2(u), and $\sigma^2$ is a value $\sigma^2$ found at S320.

$$G(q, \sigma^2) = \frac{1}{\sqrt{2\pi}\,\sigma}\exp\left(-\frac{1}{2}\cdot\frac{q^2}{\sigma^2}\right) \tag{14}$$

On the other hand, the quantity I(p1, p2) representing a difference between the probability density function p1(z) and the probability density function p2(z) is obtained by integrating, for a variable z, a square error obtained by multiplying a difference between the probability density function p1(z) and the probability density function p2(z) by itself.

$$I(p1, p2) = \int_{-\infty}^{\infty} (p1(z) - p2(z))^2\, dz \tag{15}$$

If the formula (15) is expanded by using a known relationship represented by the formula (20), then, I(p1, p2) can be expressed by the formula (16). As for the known relationship represented by the formula (20), reference should be made to Simon S. Haykin, "Unsupervised Adaptive Filtering, Volume 1, Blind Source Separation", Wiley, p. 290, the contents of which are incorporated herein by reference.

$$I(p1, p2) = \frac{1}{(N-2)^2}[V1(Y1) + V2(Y2) - 2 \cdot V12(Y1, Y2)] \tag{16}$$

$$V1(Y1) = \sum_{n,m=2}^{N-1} G(Y1(n) - Y1(m), 2\sigma^2) \tag{17}$$

$$V2(Y2) = \sum_{n,m=2}^{N-1} G(Y2(n) - Y2(m), 2\sigma^2) \tag{18}$$

$$V12(Y1, Y2) = \sum_{n,m=2}^{N-1} G(Y1(n) - Y2(m), 2\sigma^2) \tag{19}$$

$$\int_{-\infty}^{\infty} G(z - q1, \sigma_1^2)G(z - q2, \sigma_2^2)dz = G((q1 - q2), (\sigma_1^2 + \sigma_2^2)) \tag{20}$$

Therefore, a partial differential $\partial I/\partial a_i$ for the variable $a_i$(i=0, 1, 2) of I(p1, p2) can be expressed by the formula (21).

$$\frac{\partial I}{\partial a} = \sum_{k=2}^{N-1}\left(\frac{\partial I}{\partial Y1(k)} \cdot \frac{\partial Y1(k)}{\partial a_i} + \frac{\partial I}{\partial Y2(k)} \cdot \frac{\partial Y2(k)}{\partial a_i}\right) \tag{21}$$

$$\frac{\partial I}{\partial Y1(k)} = \frac{1}{(N-2)^2} \cdot \left[\frac{\partial V1}{\partial Y1(k)} - 2\frac{\partial V12}{\partial Y1(k)}\right] \tag{22}$$

$$\frac{\partial I}{\partial Y2(k)} = \frac{1}{(N-2)^2} \cdot \left[\frac{\partial V2}{\partial Y2(k)} - 2\frac{\partial V12}{\partial Y2(k)}\right] \tag{23}$$

$$\frac{\partial V1}{\partial Y1(k)} = \sum_{n=2}^{N-1}\left(\frac{Y1(n) - Y1(k)}{\sigma^2} \cdot G((Y1(k) - Y1(n)), 2\sigma^2)\right) \tag{24}$$

$$\frac{\partial V12}{\partial Y1(k)} = \sum_{n=2}^{N-1}\left(\frac{Y2(n) - Y1(k)}{\sigma^2} \cdot G((Y1(k) - Y2(n)), 2\sigma^2)\right) \tag{25}$$

$$\frac{\partial V2}{\partial Y2(k)} = \sum_{n=2}^{N-1}\left(\frac{Y2(n) - Y2(k)}{\sigma^2} \cdot G((Y2(k) - Y2(n)), 2\sigma^2)\right) \tag{26}$$

$$\frac{\partial V12}{\partial Y2(k)} = \sum_{n=2}^{N-1}\left(\frac{Y1(n) - Y2(k)}{\sigma^2} \cdot G((Y1(n) - Y2(k)), 2\sigma^2)\right) \tag{27}$$

$$\frac{\partial Y1(k)}{\partial a_i} = y_i(k) \cdot s(a_i) \cdot (1 - s(a_i)) \tag{28}$$

$$\frac{\partial Y2(k)}{\partial a_i} = -y_i(k) \cdot s(a_i) \cdot (1 - s(a_i)) \tag{29}$$

Therefore, if the value found at S340 and S350 is substituted for Y1(u), Y2(u) (u=2, 3, - - - , N−2, N−1) in the formulas (21) to (29), if the value calculated by the signal-decomposing unit 45 is substituted for $y_i$(u) (i=0, 1, 2) and if the present setpoint value $b_i$(r) is substituted for the variable $a_i$, then, there can be found the slopes $\partial I/\partial a_0(a_0 b_0(r))$, $\partial I/\partial a_1(a_1=b_1(r))$ and $\partial I/\partial a_2(a_2=b_2(r))$ at $b_i$(r).

The signal-synthesizing unit 47 finds the slopes $\partial I/\partial a_0$ ($a_0=b_0(r)$), $\partial I/\partial a_1(a_1=b_1(r))$ and $\partial I/\partial a_2(a_2=b_2(r))$ with the value $b_i$(r) that is set to be the present variable $a_i$ by the above method (S360), adds up a value obtained by multiplying the slopes by a positive constant β and the value $b_i$(r) of the variable $a_i$ that has now been set, to obtain a value $b_i$(r+1). Thereafter, the variable $a_i$ is updated to $b_i$(r+1) (S370).

$$a_0=b_0(r+1)$$

$$a_1=b_1(r+1)$$

$$a_2=b_2(r+1)$$

$$b_i(r+1) = b_i(r) + \beta \cdot \frac{\partial I}{\partial a_i}(a_i = b_i(r)) \tag{30}$$

Thereafter, the signal-synthesizing unit 47 increases the value of the variable r by 1 (S380) and judges whether the value of the variable r after being increased is greater than a predetermined constant R (S390). Here, when it is judged that the variable r is smaller than the constant R (no at S390), the signal-synthesizing unit 47 returns back to S340 and executes the processing of S340 to S370 by using the value that has been set to be the variable $a_i$ at S370. Thereafter, the value of the variable r is increased again by 1 at S380, and it is judged at S390 whether the value of the variable r after being increased is greater than the constant R.

When it is judged that the value of the variable r is greater than the constant R (yes at S390), the signal-synthesizing unit 47 forms a first synthesized signal Y1(u) (S400) in compliance with the formula (9) by using the value $b_i$(R+1) finally set to be the variable $a_i$ at S370. By using the value $b_i$(R+1) finally set to be the variable $a_i$ at S370, further, a second synthesized signal Y2(u) is formed in compliance with the formula (10) (S410). That is, the signal-synthesizing unit 47 sets the value $b_i$(R+1) to be the variable $a_i$ at S370 to determine a weighing rule (variable $a_i$) by which the quantity I(p1, p2) representing the difference between the probability density functions becomes a maximum, and forms, at S400 and S410, the synthesized signals Y1(u) and Y2(u) by which the quantity I(p1, p2) representing the difference between the probability density functions becomes a maximum.

Thereafter, the signal-synthesizing unit 47 produces the first synthesized signal Y1(u) and the second synthesized signal Y2(u) (S420) formed at S400 and S410.

Figure 5:
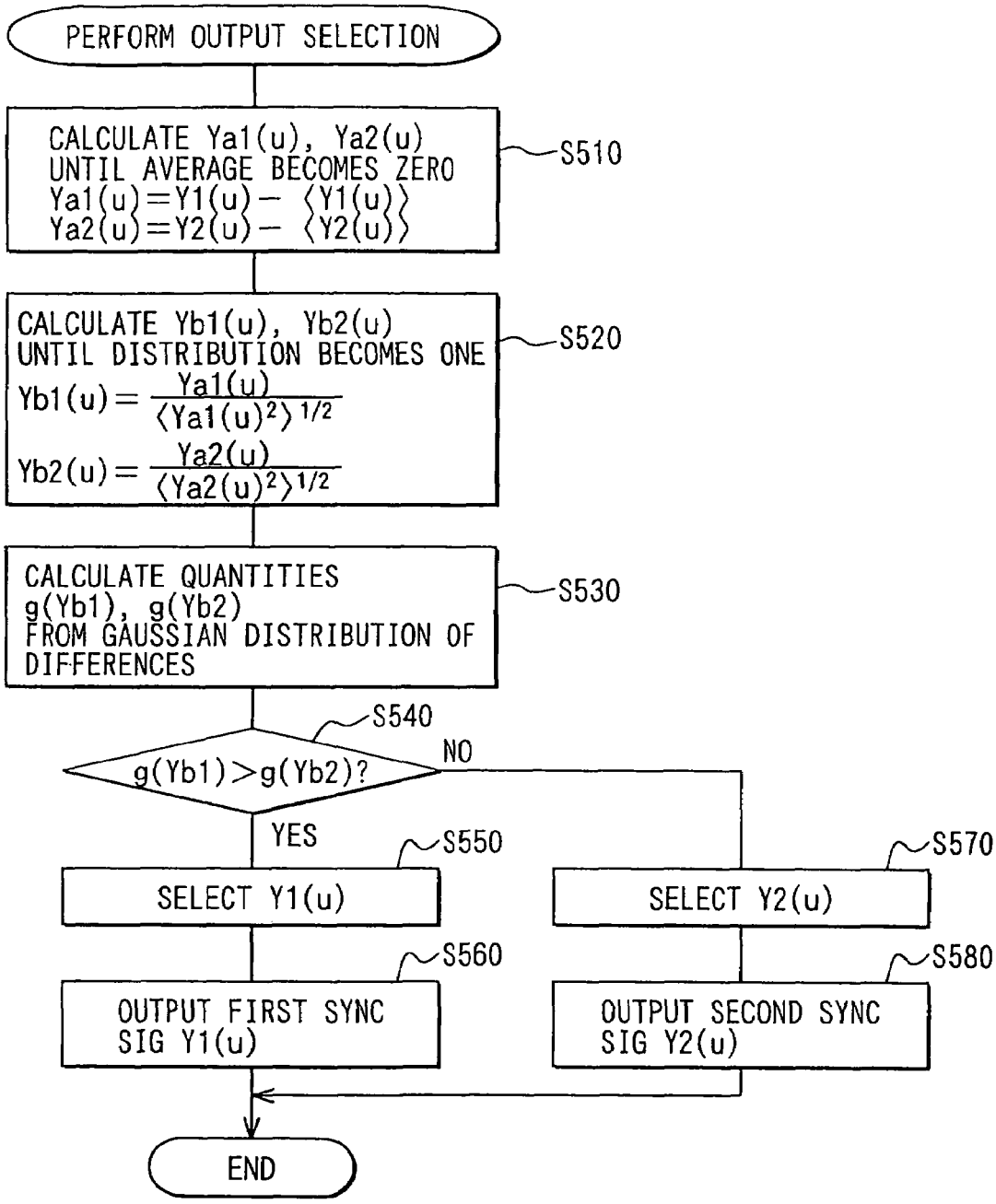
FIG. 5 is a flowchart illustrating a selective output processing executed by a output selection unit.

Described next is the constitution of the output selection unit 49 which receives the synthesized signals Y1(u) and Y2(u) from the signal-synthesizing unit 47. FIG. 5 is a flowchart illustrating the selective output processing which the output selection unit 49 executes upon receiving the synthesized signals Y1(u) and Y2(u) from the signal-synthesizing unit 47.

Upon executing the selective output processing shown in FIG. 5, the output selection unit 49 converts the synthesized signals Y1(u) and Y2(u) into Ya1(u) and Ya2(u) such that an average value thereof becomes zero (S510) to evaluate the synthesized signals Y1(u) and Y2(u) obtained from the signal-synthesizing unit 47 for their difference from the Gaussian distribution.

$$Ya1(u)=Y1(u)-\langle Y1(u)\rangle \tag{31}$$

$$Ya2(u)=Y2(u)-\langle Y2(u)\rangle \tag{32}$$

Here, <Y1(u)> is an average value of Y1(u), i.e., a value obtained by dividing the sum of Y1(2), Y1(3), - - - , Y1(N−2), Y1(N−1) by the data number (N−2). Similarly, <Y2(u)> is an average value of Y2(u), i.e., a value obtained by dividing the sum of Y2(2), Y2(3), - - - , Y2(N−2), Y2(N−1) by the data number (N−2).

The output selection unit 49 converts Ya1(u) and Ya2(u) into Yb1(u) and Yb2(u), so that the distribution becomes 1 (S520).

$$Yb1(u)=Ya1(u)/\langle Ya1(u)^2\rangle^{1/2} \tag{33}$$

$$Yb2(u)=Ya2(u)/\langle Ya2(u)^2\rangle^{1/2} \tag{34}$$

Here, $<Ya1(u)^2>$ is an average value of $Ya1(u)^2$, i.e., a value obtained by dividing the sum of $Ya1(2)^2$, $Ya1(3)^2$, - - - , $Ya1(N-2)^2$ and $Ya1(N-1)^2$ by the data number (N−2). Similarly, $<Ya2(u)^2>$ is an average value of $Ya2(u)^2$.

Thereafter, the output selection unit 49 proceeds to S530 where Yb1(u) and Yb2(u) are substituted for the functions g(q(u)) to evaluate the difference from the Gaussian distribution, to thereby obtain function values g(Yb1(u)), g(Yb2(u)).

$$g(q(u)) = \frac{1}{2}\cdot(1+\log(2\pi)) - \left(\frac{36}{8\sqrt{3}-9}\cdot\left(\frac{1}{N-2}\cdot\sum_{u=2}^{N-1}\left\{q(u)\cdot\exp\left(-\frac{1}{2}\cdot q(u)^2\right)\right\}\right)^2 + \frac{1}{2-\frac{6}{\pi}}\cdot\left(\frac{1}{N-2}\sum_{u=2}^{N-1}|q(u)| - \sqrt{\frac{2}{\pi}}\right)^2\right) \tag{35}$$

Here, the function g(q(u)) represents the magnitude of deviation of the variable q(u) from the Gaussian distribution. As for the function g, reference should be made to A. Hyvarinen, "New Approximations of Differential Entropy for Independent Component Analysis and Projection Pursuit", In Advances in Neutral Information Processing Systems 10 (NIPS-97) pp. 273-279, MIT Press, 1998, the contents of which are incorporated herein by reference.

The function g(q(u)) produces a large value when the variable q(u) is greatly deviated from the Gaussian distribution and produces a small value when the variable q(u) is deviated little from the Gaussian distribution. As is widely known, the noise represents a Gaussian distribution. Therefore, when the function value g(Yb1(u)) is greater than the function value g (Yb2(u)), it can be said that the synthesized signal Y2(u) is more favorably expressing the feature as a noise component than the synthesized signal Y1(u). In other words, when the function value g (Yb1(u)) is greater than the function value g (Yb2(u)), it can be said that the synthesized signal Y1(u) is more favorably expressing the feature as a voice component than the synthesized signal Y2(u).

After the function values g(Yb1(u)), g(Yb2(u)) are calculated at S530, therefore, it is judged whether the function value g(Yb1(u)) is greater than the function value g(Yb2(u)) (S540). When it is judged that the function value g (Yb1(u)) is greater than the function value g (Yb2(u)) (yes at S540), the first synthesized signal Y1(u) is selected between the synthesized signals Y1(u) and Y2(u) as a signal to be output (S550), and is selectively output to the recognizing unit 35 (S560).

On the other hand, when it is judged that the function value g(Yb1(u)) is smaller than the function value g(Yb2(u)) (no at S540), the output selectionunit49 selects the synthesized signal Y2(u) as a signal to be output (S570), and selectively outputs the second synthesized signal Y2(u) to the recognizing unit 35 (S580). After the end of the processing at S560 or S580, the output selection unit 49 ends the selective output processing.

In the foregoing were described the constitutions of the voice recognizing apparatus 30 and the navigation system 1. The signal-decomposing unit 45 may execute a signal-decomposing processing illustrated in FIG. 6 instead of the signal-decomposing processing illustrated in FIG. 3A to extract a plurality of signal components $y_0(u)$, $y_1(u)$ and $y_2(u)$ which are uncorrelated to each other.

Figure 6:
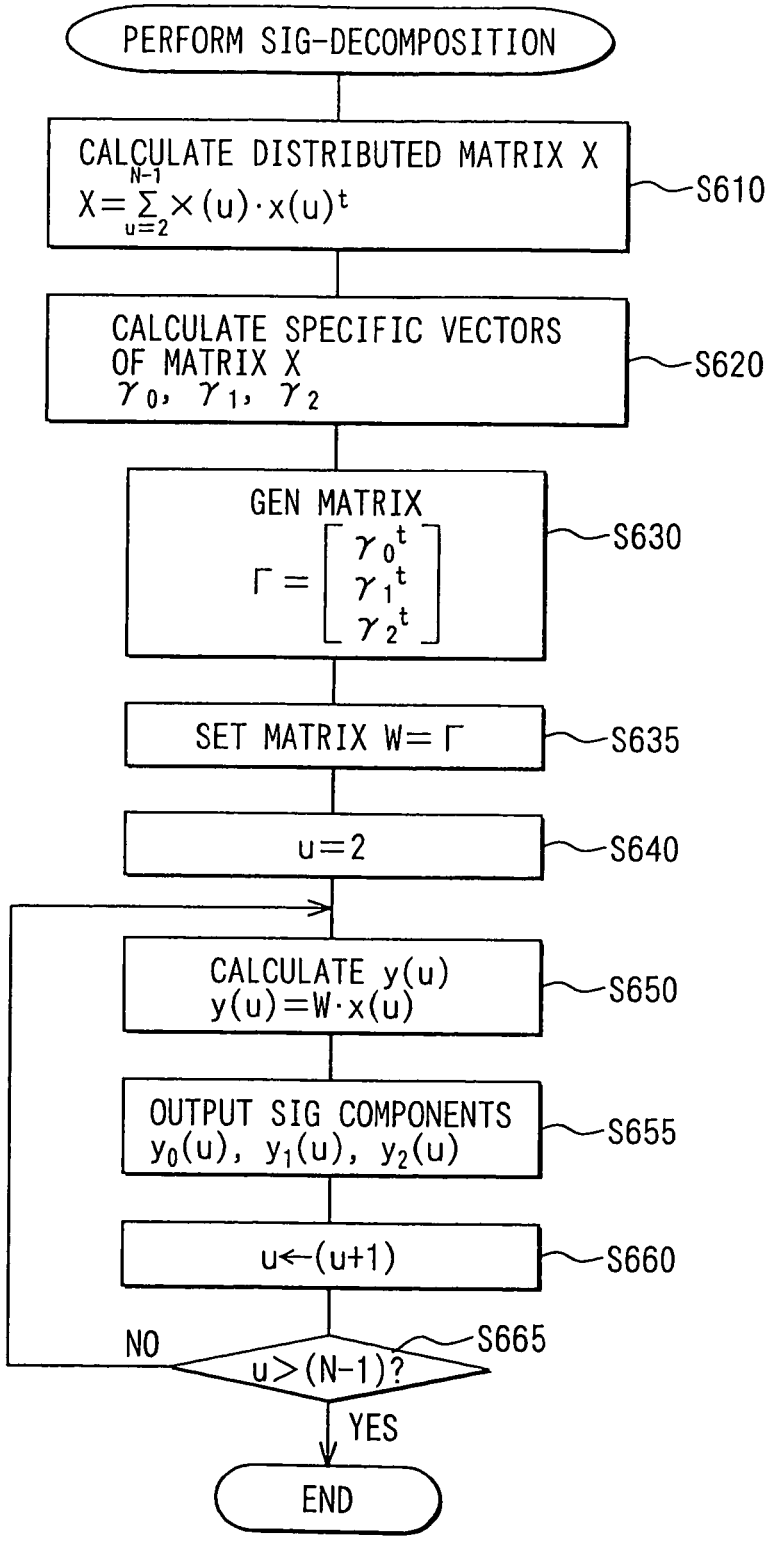
FIG. 6 is a flowchart illustrating a signal-decomposition processing of a modified embodiment executed by the signal-decomposing unit.

FIG. 6 is a flowchart illustrating the signal-decomposing processing of a modified embodiment executed by the signal-decomposing unit 45 for extracting a plurality of signal components $y_0(u)$, $y_1(u)$ and $y_2(u)$ which are uncorrelated to each other. The signal-decomposing processing is repeated for every second, and signal components $y_0(u)$, $y_1(u)$ and $y_2(u)$ uncorrelated to each other are extracted based on a method of analyzing chief components.

Upon executing the signal-decomposing processing illustrated in FIG. 6, the signal-decomposing unit 45 calculates a 3-row by 3-column matrix X (referred to as a distributed matrix) expressed by the following formula by using one second of digital voice signals mm(N−1), mm(N−2), - - - , mm(1), mm(0) (S610). Here, the vector x (u) is constituted as expressed by the formula (3).

$$X = \sum_{u=2}^{N-1}\{x(u)\cdot x(u)^t\} \tag{36}$$

Thereafter, the signal-decomposing unit 45 calculates (S620) specific vectors $\gamma_0$, $\gamma_1$ and $\gamma_2$ of the matrix X calculated at S610. The method of calculating the specific vectors has been widely known and is not described here.

$$\gamma_0=(\gamma_{00}\,\gamma_{01}\,\gamma_{02})^t$$

$$\gamma_1=(\gamma_{10}\,\gamma_{11}\,\gamma_{12})^t$$

$$\gamma_2=(\gamma_{20}\,\gamma_{21}\,\gamma_{22})^t$$

After the processing at S620, the signal-decomposing unit 45 forms a matrix Γ (S630) by using the specific vectors $\gamma_0$, $\gamma_1$ and $\gamma_2$ calculated at S620.

$$\Gamma = \begin{bmatrix} \gamma_{00} & \gamma_{01} & \gamma_{02} \\ \gamma_{10} & \gamma_{11} & \gamma_{12} \\ \gamma_{20} & \gamma_{21} & \gamma_{22} \end{bmatrix} \tag{37}$$

Thereafter, the signal-decomposing unit 45 sets the above calculated matrix Γ to be the matrix W (W=Γ) (S635), sets impulse responses (filter coefficients) capable of extracting uncorrelated signal components $y_0(u)$, $y_1(u)$ and $y_2(u)$ to the filters FL0, FL1 and FL2, and executes the subsequent processing S640 to S665 to extract uncorrelated signal components $y_0(u)$, $y_1(u)$ and $y_2(u)$ from the digital voice signals x(u).

Concretely speaking, the signal-decomposing unit 45 sets the variable u to be the initial value u=2 (S640), calculates (S650) the signal components $y_0(u)$, $y_1(u)$ and $y_2(u)$ in compliance with the formula (1) by using the matrix W set at S635, and outputs them (S655). Thereafter, the signal-decomposing unit 45 increases the value of the variable u by 1 (S660), and judges whether the value of the variable u after being increased is larger than the maximum value (N−1) (S665). When it is judged that the value of the variable u is smaller than the maximum value (N−1) (no at S665), the routine returns back to S650 where the signal components $y_0(u)$, $y_1(u)$ and $y_2(u)$ are calculated for the variable u after increased and are output (S655). When it is judged that the value of the variable u after increased is larger than the maximum value (N−1) (yes at S665), on the other hand, the signal-decomposing processing ends.

Figure 7:
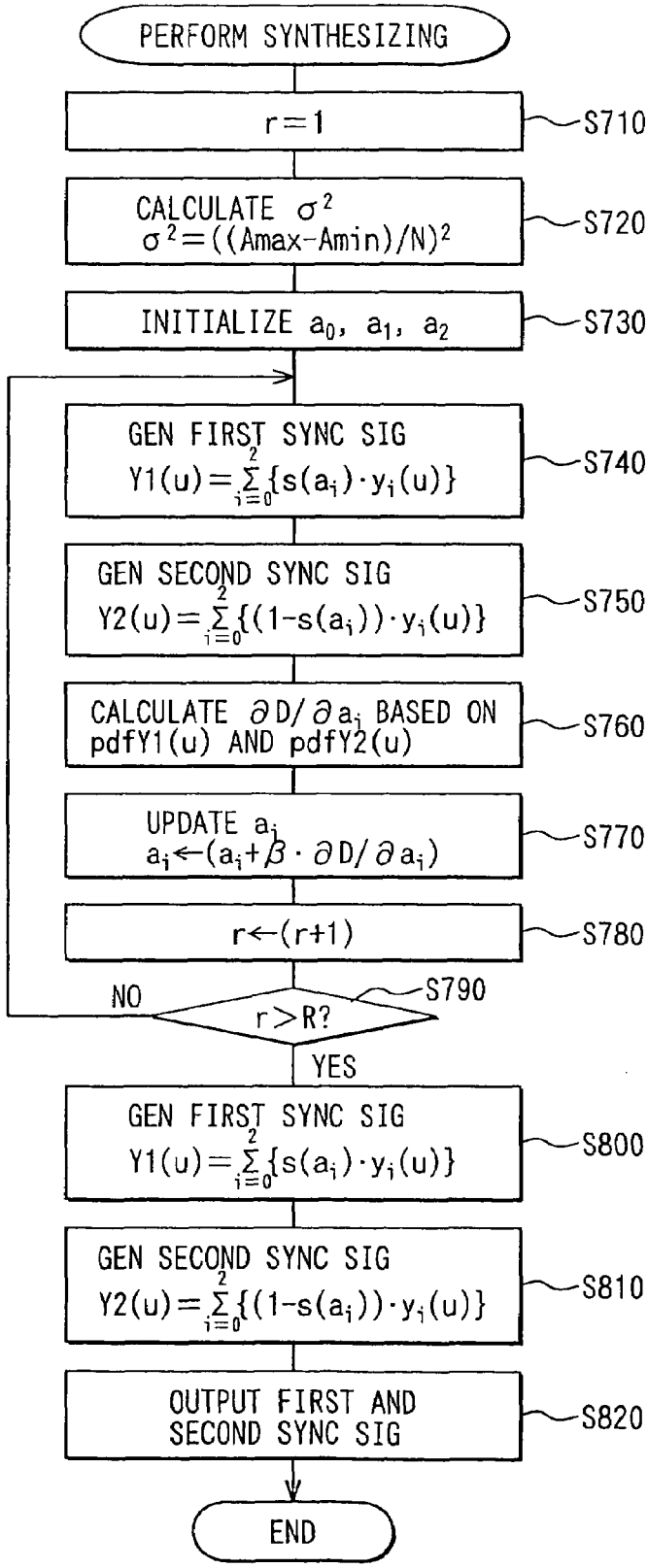
FIG. 7 is a flowchart illustrating a synthesizing processing of a modified embodiment executed by the signal-synthesizing unit.

Further, the signal-synthesizing unit 47 may form synthesized signals y1(u) and Y2(u) that are to be output by setting the variables $a_0$, $a_1$, $a_2$ that the mutual data quantity M(Y1, Y2) of the synthesized signals Y1(u) and Y2(u) becomes a minimum (see FIG. 7). The mutual data quantity M(Y1, Y2) is minimized from such a standpoint that the voice component and the noise component are approximately independent from each other That is, if the mutual data quantity M(Y1, Y2) is minimized, either one of the synthesized signal Y1(u) or Y2(u) becomes a signal representing the voice component and the other one becomes a signal representing the noise component.

FIG. 7 is a flowchart illustrating the synthesizing processing of a modified embodiment executed by the signal-synthesizing unit 47. Described below is the synthesizing processing of a modified embodiment. First, simply described below is the principle of the synthesizing processing of the modified embodiment. As is well known, the mutual data quantity M(Y1, Y2) of Y1(u) and Y2(u) can be represented by the following formula (38).

$$M(Y1, Y2) = H(Y1) + H(Y2) - H(Y1, Y2) \tag{38}$$

$$H(Y1) = -\int_{-\infty}^{\infty} p1(z)\cdot \log p1(z)\,dz \tag{39}$$

$$H(Y2) = -\int_{-\infty}^{\infty} p2(z)\cdot \log p2(z)\,dz \tag{40}$$

Here, p1(z) is a probability density function of the synthesized signal Y1(u) and p2(z) is a probability density function of the synthesized signal Y2(u) (see the formulas (12) and (13)). Further, H(Y1) is an entropy of Y1(u) and H(Y2) is an entropy of Y2(u). H(Y1, Y2) is an entropy of the composite events Y1 and Y2. Namely, H(Y1, Y2) is an entropy of the composite events Y1 and Y2, and is equal to the entropy of the original data voice signal, and remains constant for the variable $a_i$.

In this embodiment, the object is to set such variables $a_0$, $a_1$, $a_2$ that minimize the mutual data quantity M(Y1, Y2). By utilizing H(Y1, Y2) which remains constant, therefore, the quantity D(Y1, Y2) equivalent to the mutual data quantity M(Y1, Y2) is defined as follows:

$$D(Y1, Y2) = -(H(Y1) + H(Y2)) \tag{41}$$

By defining the quantity D(Y1, Y2) as above, the variables $a_0$, $a_1$ and $a_2$ are so set as to maximize D(Y1, Y2) making it possible to minimize the mutual data quantity M(Y1, Y2). In the synthesizing processing illustrated in FIG. 7, therefore, the variables $a_0$, $a_1$ and $a_2$ are set to maximize D(Y1, Y2) thereby to form synthesized signals Y1(u) and Y2(u) that are to be sent to the output selection unit 49.

Upon executing the synthesizing processing of the modified embodiment of FIG. 7, the signal-synthesizing unit 47 sets the variable r to the initial value r=1 (S710), and calculates a value $\sigma^2$ according to the formula (8) based on a maximum amplitude $A_{max}$ and a minimum amplitude $A_{min}$ in the initial one second of digital voice signals mm(N−1), , mm(0) from which the signal components $y_0(u)$, $y_1(u)$ and $y_2(u)$ were extracted by the signal-decomposing unit 45 (S720).

Thereafter, the signal-synthesizing unit 47 sets the variables $a_0$, $a_1$ and $a_2$ to be the initial values (S730), and forms a dummy first synthesized signal Y1(u) and a second synthesized signal Y2(u) for u=2, 3, - - - , N−2, N−1 in compliance with the formulas (9) and (10) (S740, S750).

After the synthesized signals Y1(u) and Y2(u) are formed, the signal-synthesizing unit 47 calculates the slopes $\partial D/\partial a_0$ ($a_0$=b0(r)), $\partial D/\partial a_1$($a_1$=b1(r)) and $\partial D/\partial a_2$($a_2$=b2(r)) of D(Y1, Y2) which is equivalent to the mutual data quantity M(Y1, Y2) of the synthesized signals Y1(u) and Y2(u) based on the probability density function p1(z) of the synthesized signal Y1(u) and on the probability density function p2(z) of the synthesized signal Y2(u) (S760). Here, when the variable is r=1, 2, - - - , R−1, R, the value set to be the variable $a_i$ at S740 to S760 is denoted as $b_i(r)$.

Concretely speaking, in calculating $\partial D/\partial a_0(a_0=b_0(r))$ $\partial D/\partial a_1(a_1=b_1(r))$ and $\partial D/\partial a_2(a_2=b_2(r))$, the entropy H(Y1) is approximated by a square integration of a difference between the probability density function p1(z) of Y1(u) and a uniform probability density function u(z) of when Y1(u) is uniformly distributed while the entropy H(Y1) is a maximum. Similarly, the entropy H(Y2) is approximated by a square integration of a difference between the probability density function p2(z) of Y2(u) and a uniform probability density function u(z) when Y2(u) is uniformly distributed while the entropy H(Y2) is a maximum.

$$H(Y1) = -\int_{-\infty}^{\infty} \{u(z) - p1(z)\}^2\,dz \tag{42}$$

$$H(Y2) = -\int_{-\infty}^{\infty} \{u(z) - p2(z)\}^2\,dz \tag{43}$$

$$D(Y1, Y2) = \int_{-\infty}^{\infty} \{u(z) - p1(z)\}^2\,dz + \int_{-\infty}^{\infty} \{u(z) - p2(z)\}^2\,dz \tag{44}$$

By approximating the entropies H(Y1) and H (Y2) as described above, it is allowed to calculate $\partial D/\partial a_0(a_0=b_0(r))$, $\partial D/\partial a_1(a_1=b_1(r))$ and $\partial D/\partial a_2(a_2=b_2(r))$ by the same method as the one used for the above I(p1, p2). Based on the above method, the signal-synthesizing unit 47 finds the slopes $\partial D/\partial a_0(a_0=b_0(r))$, $\partial D/\partial a_1(a_1=b_1(r))$ and $\partial D/\partial a_2(a_2=b_2(r))$ with the value $b_i$ (r) that has now been set to be the variable $a_i$(i=0, 1, 2) (S760), adds up a value obtained by multiplying the slope by a positive constant β and a value $b_i(r)$ that has now been set to be the variable $a_i$(i=0, 1, 2), to obtain a value $b_i(r+1)$. The value of the variable $a_i$ is then varied to $b_i(r+1)$ (S770).

$$b_i(r+1) = b_i(r) + \beta\cdot \frac{\partial D}{\partial a_i}(a_i = b_i(r)) \tag{45}$$

Thereafter, the signal-synthesizing unit 47 increases the value of the variable r by 1 (S780) and judges whether the value of the variable r after increased is greater than a predetermined constant R (S790). Here, when it is judged that the variable r is smaller than the constant R (no at S790), the signal-synthesizing unit 47 returns the processing back to S740, and executes the above processing of S740 to S770 by using a value set to be the variable $a_i$ at S770. Thereafter, the signal-synthesizing unit 47 increases the variable r again by 1 (S780) and judges at S790 whether the value of the variable r after increased is greater than the constant R.

When it is judged that the value of the variable r is greater than the constant R (yes at S790), the signal-synthesizing unit 47 proceeds to S800, and forms the first synthesized signal Y1(u) in compliance with the formula (9) by using the value $b_i(R+1)$ finally set to be the variable $a_i$ at S770. By using the value $b_i(R+1)$ finally set to be $a_i$ at S770, further, the signal-synthesizing unit 47 forms the second synthesized signal Y2(u) in compliance with the formula (10) (S810).

That is, by setting the value $b_i(R+1)$ to be the variable $a_i$ at S770, the signal-synthesizing unit 47 determines a weighing rule (variable $a_i$) by which the quantity D(Y1, Y2) becomes a maximum or, in other words, the mutual data quantity M(Y1, Y2) becomes a minimum, and forms, at S800 and S810, the synthesized signals Y1(u) and Y2(u) with which the mutual data quantity M(Y1, Y2) becomes a minimum. Thereafter, the signal-synthesizing unit 47 sends the first synthesized signal Y1(u) and the second synthesized signal Y2(u) formed at S800 and S810 to the output selection unit 49 (S820), and ends the synthesizing processing.

Figure 8:
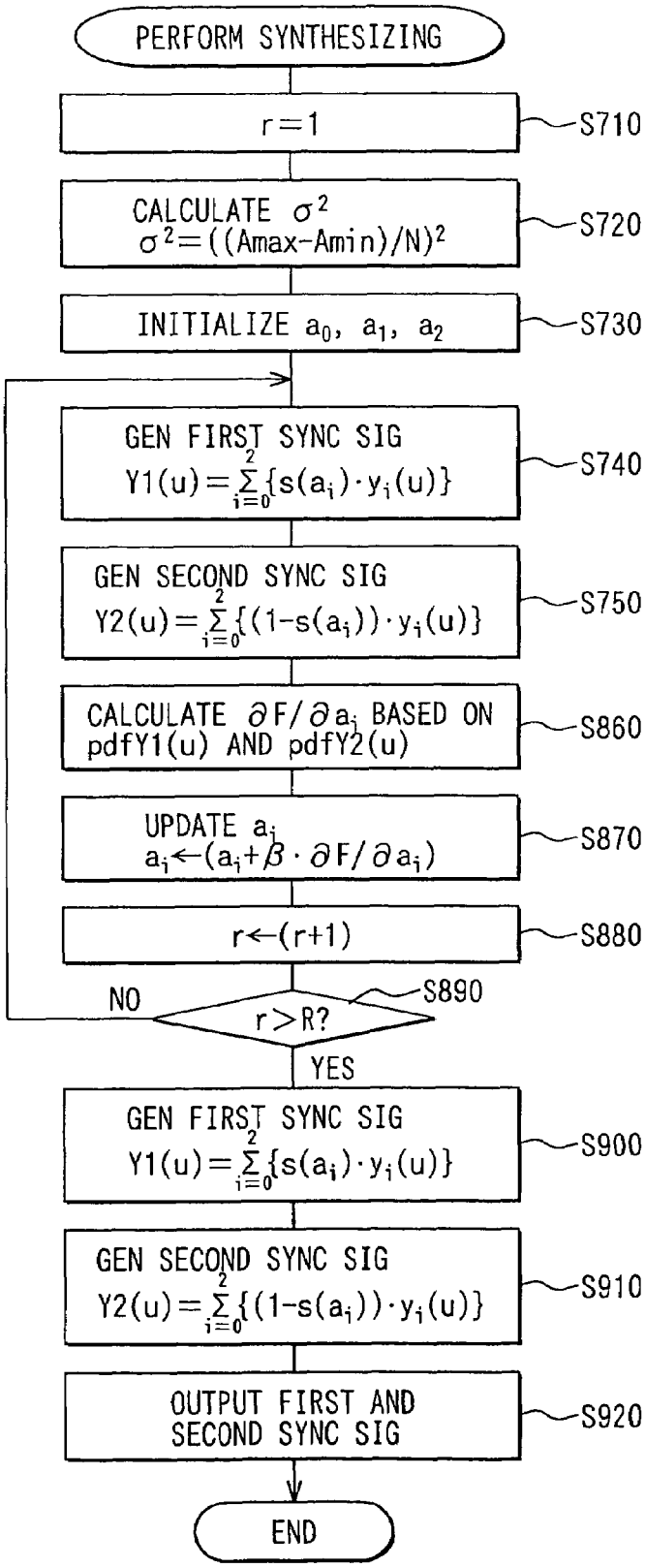
FIG. 8 is a flowchart illustrating a synthesizing processing of a second modified embodiment executed by the signal-synthesizing unit.

In the foregoing was described the synthesizing processing of the modified embodiment for setting the variable $a_i$ by using the quantity D(Y1, Y2) as an index instead of using the quantity I(p1, p2) that represents the difference between the probability density functions. It is, however, also allowable to so constitute the synthesizing processing as to set the variable $a_i$ by using both I(p1, p2) and D(Y1, Y2) as indexes. FIG. 8 is a flowchart illustrating the synthesizing processing according to a second modified embodiment which sets the variable $a_i$ by using both I(p1, p2) and D(Y1, Y2) as indexes.

In the synthesizing processing of the second modified embodiment illustrated in FIG. 8, the quantity F is defined as given below by using I(p1, p2) and D(Y1, Y2), and a variable $a_i$ with which the quantity F becomes a maximum is found to form the synthesized signals Y1(u) and Y2(u) with which the quantity I(p1, p2) expressing the difference between the probability density functions increases and the mutual data quantity M(Y1, Y2) decreases. A constant $\epsilon$ in the formula (46) is a weighing coefficient which is a real number greater than zero but is smaller than 1.

$$F=\epsilon\cdot I(p1,p2)+(1-\epsilon)\cdot D(Y1,Y2) \tag{46}$$

Upon executing the synthesizing processing shown in FIG. 8, the signal-synthesizing unit 47 forms dummy synthesized signals Y1(u) and Y2(u) through the above processing of S710 to S750. Thereafter, based on the probability density function p1(z) of the synthesized signal Y1(u) and on the probability density function p2(z) of the synthesized signal Y2(u), the signal-synthesizing unit 47 calculates the slopes (S860). Here, when the variable is r=1, 2, - - - , R−1, R, the value set to be the variable $a_i$ at S740, S750 and S860 is denoted as $b_i(r)$.

$$\frac{\partial F}{\partial a_i}(a_i = b_i(r)) = \varepsilon\cdot\frac{\partial I}{\partial a_i} + (1-\varepsilon)\cdot\frac{\partial D}{\partial a_i} \tag{47}$$

After the processing at S860, the signal-synthesizing unit 47 obtains a value $b_i$r+1) by adding up the value $b_i(r)$ now set to be the variable $a_i$ and a value obtained by multiplying the slopes $\partial F/\partial a_0(a_0=b0(r))$, $\partial F/\partial a_1(a_1=b_1(r))$ and $\partial F/\partial a_2(a_2=b_2(r))$ of the value $b_i(r)$ calculated at S860 by a positive constant $\beta$. The variable $a_i$ is varied to be $b_i(r+1)$.

$$b_i(r+1) = b_i(r) + \beta\cdot\frac{\partial F}{\partial a_i}(a_i = b_i(r)) \tag{48}$$

Thereafter, the signal-synthesizing unit 47 increases the value of the variable r by 1 (S880) and judges whether the value the variable r after increased is greater than the constant r (S890). When it is judged that the variable r is smaller than the constant R (no at S890), the processing is returned back to S740. When it is judged that the value of the variable r is greater than the constant R (yes at S890), the first synthesized signal $Y_1(u)$ is formed (S900) in compliance with the formula (9) by using the value $b_i(r+1)$ which is the variable $a_i$ finally set at S870. Further, the second synthesized signal Y2(u) is formed (S910) in compliance with the formula (10) by using the value $b_i(r+1)$ which is the variable $a_i$ finally set at S870.

That is, by setting the value $b_i(R+1)$ to be the variable $a_i$ at S870, the signal-synthesizing unit 47 determines a weighing rule (variable $a_i$) by which the quantity F becomes a maximum, and forms, at S900 and S910, the synthesized signals Y1(u) and Y2(u) with which the quantity F becomes a maximum or, in other words, the mutual data quantity M(Y1, Y2) becomes small and the quantity I(p1, p2) representing the difference between the probability density functions becomes great. Thereafter, the signal-synthesizing unit 47 sends the first synthesized signal Y1(u) and the second synthesized signal Y2(u) formed at S900 and S910 to the output selection unit 49 (S920), and ends the synthesizing processing.

In the foregoing were described the voice recognizing apparatus 30 and the navigation system 1 according to the embodiment inclusive of modified embodiments. According to the voice recognizing apparatus 30, the signal-decomposing unit 45 picks up a plurality of kinds of signal components $y_0(u)$, $y_1(u)$ and $y_2(u)$ which are independent from, or uncorrelated to, each other from the digital voice signals by using a plurality of filters FL0, FL1 and FL2, and the signal-synthesizing unit 47 so determines the variable $a_i$ as to maximize the quantity I(p1, p2) that represents a difference between the probability density functions of the first and second synthesized signals Y1(u) and Y2(u), as to minimize the mutual data quantity M(Y1, Y2) for the first and second synthesized signals Y1(u) and Y2(u), or to maximize the quantity F to which is added the quantity D equivalent to the quantity I(p1, p2) representing the difference between the probability density functions and to the mutual data quantity M(Y1, Y2).

Based on the variable $a_i$ that is determined, further, the signal-synthesizing unit 47 forms the first synthesized signal Y1(u) by weighing and adding up the signal components $y_0(u)$, $y_1(u)$ and $y_2(u)$ according to the formula (9) which is the first rule, and forms the second synthesized signal Y2(u) by weighing and adding up the signal components $y_0(u)$, $y_1(u)$ and $y_2(u)$ according to the formula (10) which is the second rule.

In the voice recognizing apparatus 30, further, the output selection unit 49 evaluates the first synthesized signal Y1(u) and the second synthesized signal Y2(u) for their differences from the Gaussian distribution according to the function g of the formula (35), and selectively produces a synthesized signal having a high function value between the first and second synthesized signals Y1(u) and Y2(u) as a synthesized signal expressing the feature of voice component. Through the above operation, the voice recognizing apparatus 30 works to selectively extract only those voice components related to the voice uttered by the user from the voice signals input through the microphone MC and produces them.

As described above, the voice recognizing apparatus 30 of this embodiment extracts a plurality of kinds of signal components $y_0(u)$, $y_1(u)$ and $y_2(u)$ from the digital voice signals by using the filters FL0, FL1, FL2, synthesizes the signal components $y_0(u)$, $y_1(u)$ and $y_2(u)$ based on the quantity I(p1, p2) representing a difference between the probability density functions or on the mutual data quantity M(Y1, Y2) to form synthesized signals emphasizing only those signal components that are corresponding to the voice components. Unlike the prior art that uses the microphones in a number equal to the number of the sound sources, therefore, it is allowed to favorably extract the voice components by using a single microphone.

According to this embodiment, further, the voice components can be extracted by simply processing the signals input through a single microphone. Therefore, a product (voice recognizing apparatus 30) having excellent voice extraction performance can be inexpensively produced using neither a high-performance computer nor a memory of a large capacity.

Further, according to the second modified embodiment for determining the variable $a_i$ based on the quantity F, the synthesized signals Y1(u) and Y2(u) are formed by using, as indexes, both the quantity I(p1, p2) that represents the difference between the probability density functions of the first and second synthesized signals and the mutual data quantity M(Y1, Y2) for the first and second synthesized signals. Therefore, the voice components can be favorably extracted compared to when the synthesized signals Y1(u) and Y2(u) are formed by using either the quantity I(p1, p2) that represents the difference between the probability density functions or the mutual data quantity M(Y1, Y2) as an index.

In the voice recognizing apparatus 30 of this embodiment, further, the synthesized signals Y1(u) and Y2(u) are evaluated for their differences from the Gaussian distribution by using the above function g, and a synthesized signal expressing the feature of the voice component is selected making it possible to select the signal at a high speed and favorably.

The extraction means corresponds to the signal-decomposing unit 45. The first synthesizing means is preferably realized by the processing at S400, S800 and S900 executed by the signal-synthesizing unit 47, and the second synthesizing means is realized by the processing at S410, S810 and S910 executed by the signal-synthesizing unit 47. The selective output means corresponds to the output selection unit 49, and the evaluation means included in the selective output means is realized by the processing at S530 executed by the output selection unit 49. Further, the determining means is realized by the processing of S310 to S390 executed by the signal-synthesizing unit 47, by the processing at S710 to S790 in FIG. 7, or by the processing at S710 to S890 in FIG. 8.

The method of extracting the voice, the apparatus for extracting the voice, the apparatus for recognizing the voice and the programs according are in no way limited to those of the above-mentioned embodiments only but can be modified in a variety of other ways.

In the above embodiment, for example, FIR-type digital filters were used as the filters FL0, FL1 and FL2. However, it is also allowable to use digital band-pass filters of the IIR (infinite impulse response) type. When the IIR-type digital filters are used, the impulse responses may be updated by the filter-learning unit 45*a* relying upon a known technology, so that the signal components $y_0(u)$, $y_1(u)$ and $y_2(u)$ become independent from, or uncorrelated to, each other.

In selectively producing the synthesized signals Y1(u) and Y2(u), further, it is also allowable to derive an LPC from the synthesized signals Y1(u) and Y2(u) to evaluate which one of the synthesized signal Y1(u) or Y2(u) is expressing the feature of the voice component based on the result thereof.

What is claimed is:

1. A method of extracting voice components from a digital voice signal containing a mixture of voice components and noise components, said method comprising:

extracting a plurality of kinds of signal components from the digital voice signal containing the mixture of voice components and noise components by using a plurality of digital band-pass filters;

forming a first synthesized signal by synthesizing, according to a first rule having a first probability density function, the extracted signal components, and forming a second synthesized signal by synthesizing, according to a second rule having a second probability density function different from the first rule, the extracted signal components, a respective difference between the first and second probability density functions and a Gaussian distribution being at a maximum; and selectively producing a synthesized voice signal expressing the feature of the voice components from the first and second synthesized signals;

wherein the first and second rules are determined based on characteristic feature quantities of the first and second synthesized signals, wherein differences between the first synthesized signal and the second synthesized signal and the Gaussian distribution are evaluated to selectively output the one of the first and second synthesized signals having the greatest difference from the Gaussian distribution as the synthesized voice signal.

2. The method of claim 1, wherein the extracting of the plurality of kinds of signal components further comprises setting impulse responses of the plurality of filters so that the signal components extracted by the filters become one of independent from and uncorrelated with each other.

3. The method of claim 1, wherein the digital band-pass filters include one of a FIR type filter and an IIR type filter.

4. The method of claim 1, wherein the first and second rules are so determined that a statistic feature quantity representing the difference between the first and second probability density functions of the first and second synthesized signals becomes maximum.

5. The method of claim 1, wherein the first and second rules include weighing and adding the signal components and the second synthesized signal.

6. An apparatus for selectively extracting voice components from a digital voice signal containing a mixture of voice components and noise components, the apparatus comprising:

a plurality of digital band-pass filters;

extract means for extracting a plurality of kinds of signal components from the mixture of voice components and noise components of the digital voice signal input from an external unit by using the plurality of digital band-pass filters;

first synthesizing means for forming a first synthesized signal by synthesizing the signal components extracted by the extract means according to a first rule having a first probability density function;

second synthesizing means for forming a second synthesized signal by synthesizing the signal components extracted by the extract means according to a second rule having a second probability density function different from the first rule, a difference between the first and second probability functions and the Gaussian distribution being at a maximum;

selective output means for selectively producing a synthesized voice signal expressing the feature of the voice component from the first synthesized signal formed by the first synthesizing means and the second synthesized signal formed by the second synthesizing means; and determining means for determining the first and second rules based on a statistic feature quantity of the first synthesized signal formed by the first synthesizing means and of the second synthesized signal formed by the second synthesizing means, wherein differences between the first synthesized signal and the second synthesized signal and the Gaussian distribution are evaluated to selectively output one of the first synthesized signal and the second synthesized having the greatest difference from the Gaussian distribution as the synthesized voice signal.

7. The apparatus for selectively extracting according to claim 6, wherein the extract means sets the impulse responses of the plurality of digital band-pass filters such that the signal components extracted by the filters become one of independent from and uncorrelated with each other, and extracts the plurality of kinds of signal components from the digital voice signals by using the plurality of digital band-pass filters.

8. The apparatus for selectively extracting according to claim 6, wherein the digital band-pass filters are one of an FIR type or an IIR type.

9. The apparatus for selectively extracting according to claim 6, wherein the first and second rules are so determined that a quantity expressing the difference between the first and second probability density functions of the first and second synthesized signals becomes a maximum.

10. The apparatus for selectively extracting according to claim 6, wherein the statistic feature quantity includes a mutual data quantity and the first and second rules are determined so that the mutual data quantity for the first and second synthesized signals becomes a minimum.

11. The apparatus for selectively extracting according to claim 6, wherein:

the determining means determines that the first and second rules are associated with weighing the signal components extracted by the extract means;

the first synthesizing means weighs and adds up the signal components extracted by the extract means according to the first rule to form the first synthesized signal; and the second synthesizing means weighs and adds up the signal components extracted by the extract means according to the second rule to form the second synthesized signal.

12. The apparatus for selectively extracting according to claim 6, wherein the selective output means includes evaluation means for evaluating differences between the first synthesized signal formed by the first synthesizing means and the second synthesized signal formed by the second synthesizing means and the Gaussian distribution, and wherein the one of the first synthesized signal and the second synthesized signal evaluated by the evaluation means to possess the greatest difference from the Gaussian distribution is selectively output as the synthesized voice signal expressing the feature of the voice component.

13. An apparatus for selectively extracting according to claim 6, further comprising a voice recognition means wherein the voice is recognized by using the synthesized voice signal produced by the selective output means.

14. An article of manufacture comprising:

a computer readable medium; and instructions carried on the computer readable medium, the instructions for selectively extracting voice components from a digital voice signal containing a mixture of voice components and noise components, the instructions, when read and executed by a computer, for causing the computer to function as:

a plurality of digital band-pass filters;

extract means for extracting a plurality of kinds of signal components from the digital voice signal containing the mixture of voice components and noise components input from an external unit by using said plurality of filters first synthesizing means for forming a first synthesized signal by synthesizing the signal components extracted by said extract means according to a first rule having a first probability density function;

second synthesizing means for forming a second synthesized signal by synthesizing the signal components extracted by said extract means according to a second rule having a second probability density function different from the first rule, respective difference between the first and second probability density functions and a Gaussian distribution being at a maximum; and selective output means for selectively producing a synthesized voice signal expressing the feature of the voice component based on the first synthesized signal formed by the first synthesizing means and the second synthesized signal formed by the second synthesizing means; and determining means for determining the first and second rules based on the statistic feature quantity of the first synthesized signal formed by the first synthesizing means and of the second synthesized signal formed by the second synthesizing means wherein the respective differences between the first synthesized signal and the second synthesized signal and the Gaussian distribution are evaluated, and the synthesized signal evaluated to have the greatest difference from the Gaussian distribution is selectively output as the synthesized voice signal.

* * * * *